US008232885B2

(12) United States Patent
Hoshino et al.

(10) Patent No.: US 8,232,885 B2
(45) Date of Patent: Jul. 31, 2012

(54) PHOTOELECTRIC SMOKE DETECTOR

(75) Inventors: Tomohiro Hoshino, Tokyo (JP); Takashi Ito, Tokyo (JP); Katsuhiro Suzuki, Tokyo (JP)

(73) Assignee: Nohmi Bosai Ltd., Tokyo (JP)

( * ) Notice: Subject to any disclaimer, the term of this patent is extended or adjusted under 35 U.S.C. 154(b) by 301 days.

(21) Appl. No.: 12/566,269

(22) Filed: Sep. 24, 2009

(65) Prior Publication Data

US 2010/0079299 A1 Apr. 1, 2010

(30) Foreign Application Priority Data

Oct. 1, 2008 (JP) ..... 2008-256064
Oct. 1, 2008 (JP) ..... 2008-256102
Mar. 31, 2009 (JP) ..... 2009-086877

(51) Int. Cl.
*G08B 21/00* (2006.01)

(52) U.S. Cl. ..... 340/630; 340/628; 250/574

(58) Field of Classification Search ..... 340/628, 340/629, 630, 574, 578; 356/337, 338; 250/574
See application file for complete search history.

(56) References Cited

U.S. PATENT DOCUMENTS 4,539,556 A 9/1985 Dederich et al.
4,758,733 A * 7/1988 Mochizuki ..... 250/574
6,756,905 B2 * 6/2004 Rattman et al. ..... 340/630
2009/0009348 A1 * 1/2009 Mizuo ..... 340/630

FOREIGN PATENT DOCUMENTS

GB 2 034 028 5/1980
JP 55-7658 1/1980

OTHER PUBLICATIONS

European Patent Office Communication issued Mar. 16, 2011 in corresponding European Patent Application No. 09 252 336.4.

* cited by examiner

*Primary Examiner* — Van T. Trieu
(74) *Attorney, Agent, or Firm* — Wenderoth, Lind & Ponack, L.L.P.

(57) ABSTRACT

A photoelectric smoke detector is capable of preventing an erroneous alarm from being issued even when steam flows into a smoke detecting unit. The smoke detecting unit includes: an installation section; and a smoke inlet section. The installation section includes: a light emitting element for emitting light to an inside of the installation section; and a light receiving element for receiving the light emitted from the light emitting element. The smoke inlet section includes: a plurality of wall members for preventing external light from entering the smoke inlet section; and a smoke inlet formed between the plurality of wall members. The installation section and the smoke inlet section are arranged so as to overlap each other, with the smoke inlet section being positioned on a lower side of the installation section, and are communicated with each other through an opening.

8 Claims, 6 Drawing Sheets

(a)

(b)

(a)

(b)

PHOTOELECTRIC SMOKE DETECTOR

BACKGROUND OF THE INVENTION

1. Field of the Invention

The present invention relates to a photoelectric smoke detector, and more particularly, to a photoelectric smoke detector capable of preventing an erroneous alarm from being issued due to steam flowing into a smoke detecting unit. Further particularly, the present invention relates to a photoelectric smoke detector in which smoke inlet characteristics of a smoke detecting unit are improved.

2. Description of the Related Art

There has been proposed such a conventional photoelectric smoke detector having the following structure. That is, "a smoke detecting unit cover 11 is detachably attached to the lower surface of the smoke detecting unit body 5. A plurality of labyrinth members 13 are formed inside a peripheral wall 12 of the smoke detecting unit cover 11. The labyrinth members 13 are formed so that smoke easily flows from the outside, and that light from the outside is cut off. An insect screen 14 is integrally provided on the outside of the peripheral wall 12 of the smoke detecting unit cover 11 so that insects are prevented from invading the sensor and scattering light. In addition, a plurality of smoke inlets 15 are formed in the peripheral wall 12 of the smoke detecting unit cover 11. Holders 16 and 17, a light shielding member 18, and an attachment portion 19 are integrally formed on the lower surface of the smoke detecting unit body 5. The holder 16 accommodates a light receiving element 20 and a test infrared LED. The holder 17 accommodates a smoke-detecting infrared LED 21. The light shielding member 18 cuts off the infrared rays emitted from the smoke-detecting infrared LED 21 so that the infrared rays are not directly entered on the light receiving element 20. A projection 22 formed on the smoke detecting unit cover 11 is inserted into the attachment portion 19 so that the smoke detecting unit cover 11 is detachably attached to the smoke detecting unit body 5" (see, for example, JP 2787001 B (paragraphs 0014 to 0016 and FIGS. 2 and 3)).

The smoke detecting unit of the conventional photoelectric smoke detector (see, for example, JP 2787001 B (paragraphs 0014 to 0016 and FIGS. 2 and 3)) has the light emitting element (smoke-detecting infrared LED) and the light receiving element provided within a smoke inlet section having a peripheral edge portion on which the wall members (labyrinth members) are formed. In other words, the conventional photoelectric smoke detector does not have an installation section including a light emitting element and a light receiving element, and a smoke inlet section in a separate manner. Therefore, there arises a problem in that an erroneous alarm may be issued when steam generated in a kitchen, a bathroom of a room of a hotel, or the like flows into the smoke detecting unit.

The smoke detecting unit of the conventional photoelectric smoke detector (see, for example, JP 2787001 B (paragraphs 0014 to 0016 and FIGS. 2 and 3)) has the light emitting element (smoke-detecting infrared LED), the light receiving element, and the light shielding member provided within the smoke inlet section having the peripheral edge portion on which the wall members (labyrinth members) are formed. The light shielding member is arranged so as to extend from a bottom surface portion of the smoke inlet section to a top surface portion thereof. Therefore, there arises another problem in that the light shielding member interrupts the flow of smoke flowing into the smoke inlet section, and accordingly the smoke inlet characteristics of the smoke inlet section are degraded.

SUMMARY OF THE INVENTION

The present invention has been made in order to solve the problems as described above, and therefore it is an object of the present invention to provide a photoelectric smoke detector capable of preventing an erroneous alarm from being issued even when steam flows into a smoke detecting unit. Further, the present invention has been made in order to solve the problems as described above, and therefore it is another object of the present invention to provide a photoelectric smoke detector in which smoke inlet characteristics of a smoke inlet section are improved.

A photoelectric smoke detector according to an aspect of the present invention includes: a smoke detecting unit; and a fire determining unit for determining, based on a signal output from the smoke detecting unit, whether or not a fire has occurred. The photoelectric smoke detector outputs a fire signal when the fire determining unit determines that the fire has occurred. The smoke detecting unit includes: an installation section; and a smoke inlet section. The installation section includes: a light emitting element for emitting light to an inside of the installation section; and a light receiving element for receiving the light which is emitted from the light emitting element and is scattered by smoke particles within the smoke detecting unit. The smoke inlet section includes: a plurality of wall members for preventing external light from entering the smoke inlet section; and a smoke inlet formed between the plurality of wall members. The installation section and the smoke inlet section are arranged so as to overlap each other, with the smoke inlet section being positioned on a lower side of the installation section, and are communicated with each other through an opening.

Further, the smoke inlet section further includes a partition wall having the opening through which the smoke inlet section is communicated with the installation section, and the partition wall has a lower surface that has the plurality of wall members formed thereon, and that is formed as an inclined surface which inclines upward as approaching the opening, so as to guide smoke flowing into the smoke inlet section through the opening into the installation section.

Further, an angle of the inclined surface and an inner diameter of the opening are set so that the smoke flowing along the inclined surface of the partition wall is guided to a smoke detecting region defined in the installation section.

Further, a photoelectric smoke detector according to another aspect of the present invention includes: a smoke detecting unit; and a fire determining unit for determining, based on a signal output from the smoke detecting unit, whether or not a fire has occurred. The photoelectric smoke detector outputs a fire signal when the fire determining unit determines that the fire has occurred. The smoke detecting unit includes: an installation section; and a smoke inlet section. The installation section includes: a light emitting element for emitting light to an inside of the installation section; a light receiving element for receiving the light which is emitted from the light emitting element and is scattered by smoke particles within the smoke detecting unit; and a light shielding member for preventing the light receiving element from directly receiving the light emitted from the light emitting element. In the light emitting element and the light receiving element, an optical axis of the light emitting element and an optical axis of the light receiving element are parallel to each other in side view, and form a predetermined angle in plan view. The smoke inlet section includes: a plurality of wall members for preventing external light from entering the smoke inlet section; and a smoke inlet formed between the plurality of wall members. The installation section and the smoke inlet section are arranged so as to overlap each other, with one of the installation section and the smoke inlet section being positioned on an upper side of the installation section, and are communicated with each other through an opening. The light shielding member is disposed while being kept out of contact with a surface of the smoke inlet section opposite to the installation section.

Further, a height dimension of the installation section is larger than a height dimension of the smoke inlet section.

According to the present invention, the smoke detecting unit has the installation section including the light emitting element and the light receiving element, and the smoke inlet section in a separate manner. Further, the installation section and the smoke inlet section are arranged so as to overlap each other, with the smoke inlet section being positioned on the lower side of the installation section, and are communicated with each other through the opening. Steam flowing into the smoke inlet section is high in mass of its particles, and hence is high in inertia. Therefore, the fluid state of steam may hardly be changed. Accordingly, with this structure, the majority of steam does not flow into the installation section and passes through the smoke inlet section to exit. On the other hand, smoke flowing into the smoke inlet section is low in mass of its particles, and hence is low in inertia. Therefore, the fluid state of smoke may be changed easily, and thus the smoke flows into the installation section through the opening. Then, the light receiving element receives the light which is emitted from the light emitting element and is scattered by the smoke flowing into the installation section, and then the fire determining unit determines that a fire has occurred. Accordingly, the photoelectric smoke detector capable of determining whether or not a fire has occurred without issuing an erroneous alarm even when steam flows into the smoke detecting unit (smoke inlet section) can be obtained.

Further, the lower surface of the partition wall, on which the plurality of wall members are formed, is the inclined surface which inclines upward as approaching the opening, and the smoke flowing into the smoke inlet section is guided along the inclined surface to the opening, to thereby flow into the installation section. Thus, even smoke flowing at low speed can be guided to flow into the installation section rapidly. Accordingly, the fire detecting performance can be enhanced.

Further, the angle of the inclined surface and the inner diameter of the opening are set so that the smoke flowing along the inclined surface of the partition wall is guided to the smoke detecting region defined in the installation section. Thus, it becomes possible to realize the guiding of smoke into the smoke detecting region, and accordingly further enhance the fire detecting performance.

Further, the smoke detecting unit has the installation section including the light emitting element, the light receiving element, and the light shielding member, and the smoke inlet section in a separate manner. Further, the installation section and the smoke inlet section are arranged so as to overlap each other vertically, and are communicated with each other through the opening. In addition, the light shielding member is disposed while being kept out of contact with the surface of the smoke inlet section opposite to the installation section. Thus, the light shielding member does not interrupt the flows of the smoke flowing into the smoke inlet section, thereby improving the smoke inlet characteristics of the smoke inlet section.

Further, the height dimension of the installation section is larger than the height dimension of the smoke inlet section, and hence the smoke flowing into the smoke inlet section flows into the installation section more easily. Accordingly, the photoelectric smoke detector can determine whether or not a fire has occurred with higher accuracy.

DETAILED DESCRIPTION OF THE PREFERRED EMBODIMENT

Embodiment

Hereinafter, description is made of an embodiment of the present invention which is applied to a smoke alarm device having a structure of a photoelectric smoke detector provided with an alarm device such as a push-button switch or a buzzer.

Figure 1:
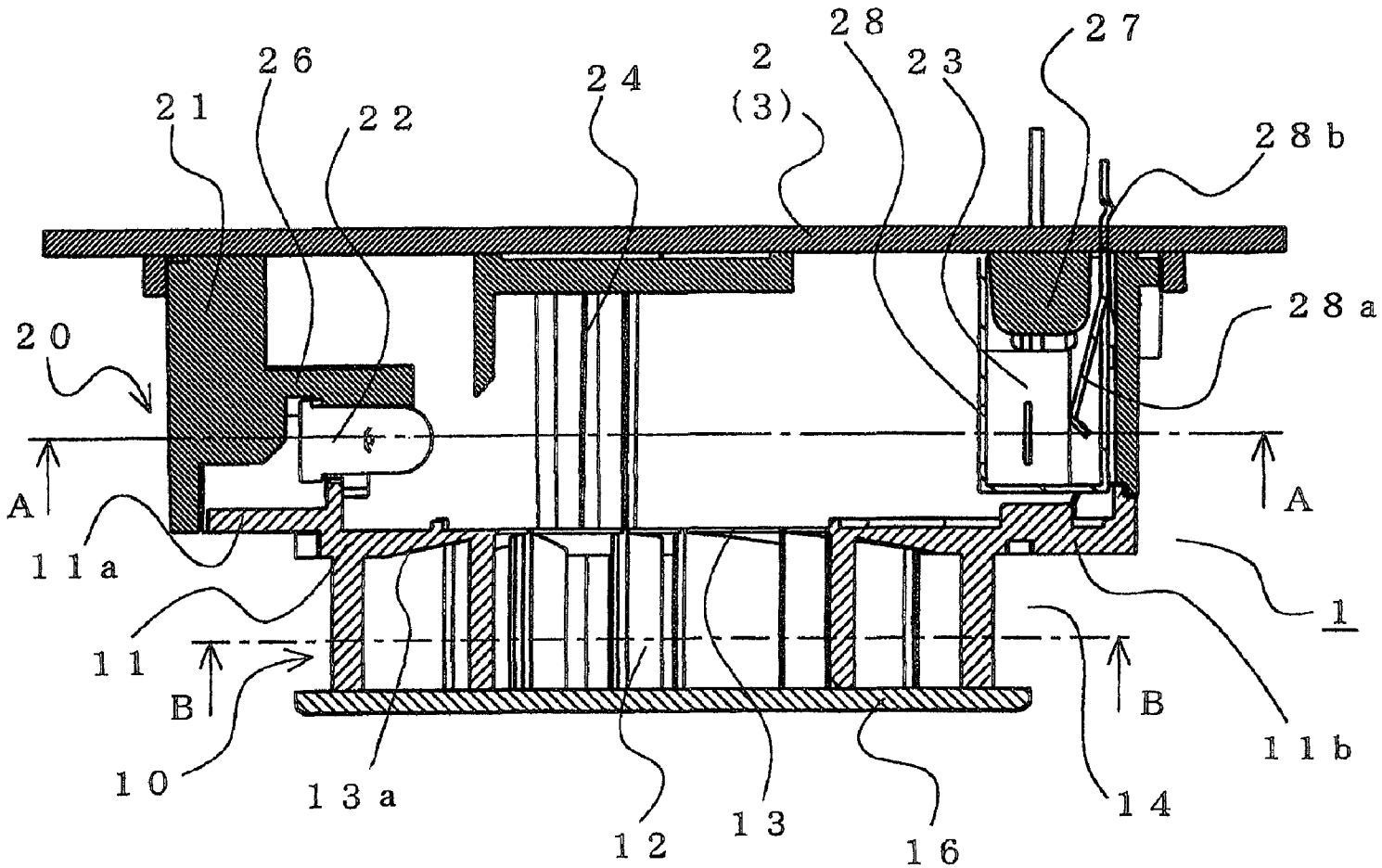
FIG. 1 is a vertical cross sectional view illustrating a smoke detecting unit of a smoke alarm device according to an embodiment of the present invention.
Figure 2:
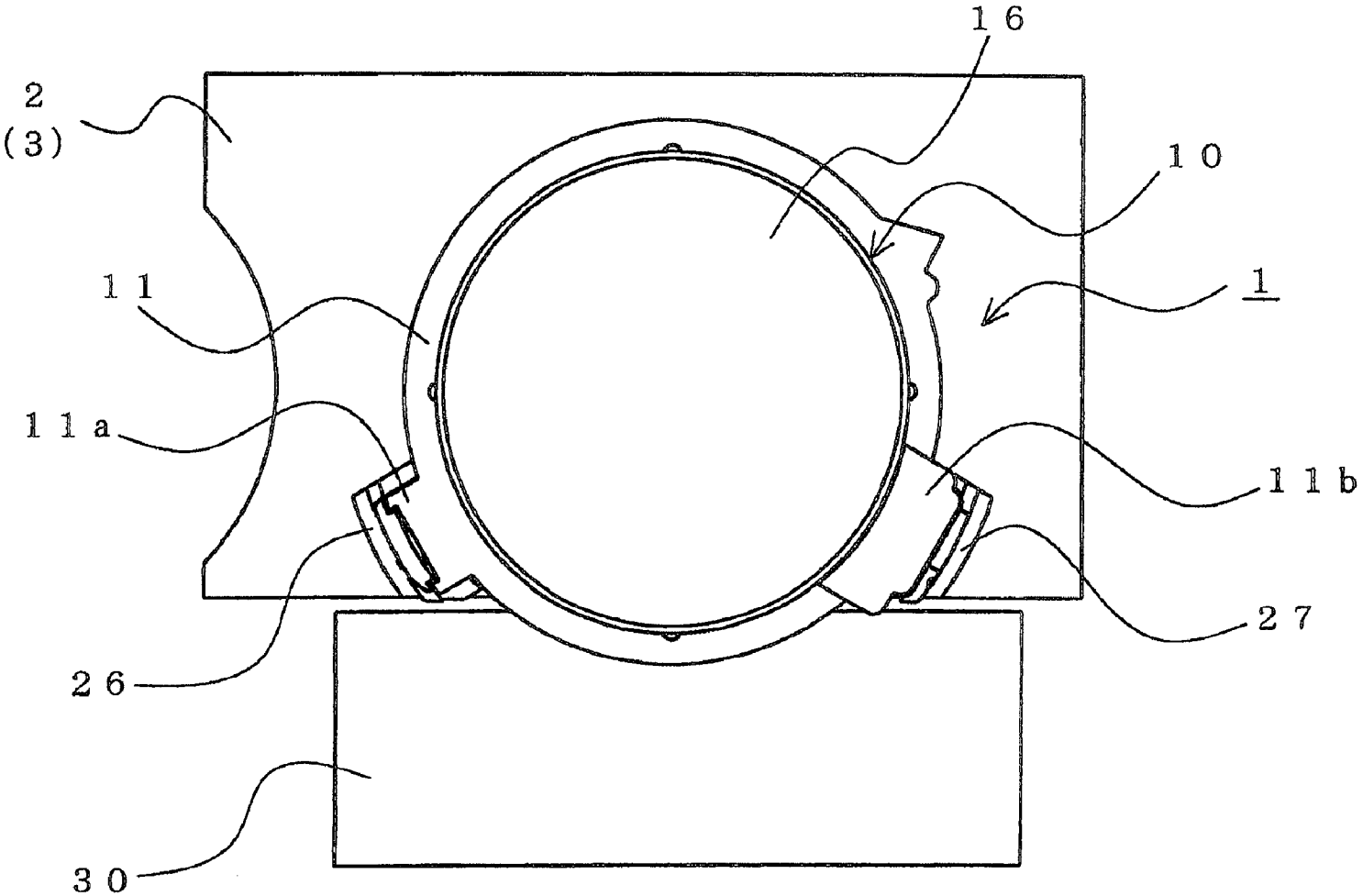
FIG. 2 is a bottom view illustrating the smoke detecting unit of the smoke alarm device according to the embodiment of the present invention.
Figure 3:
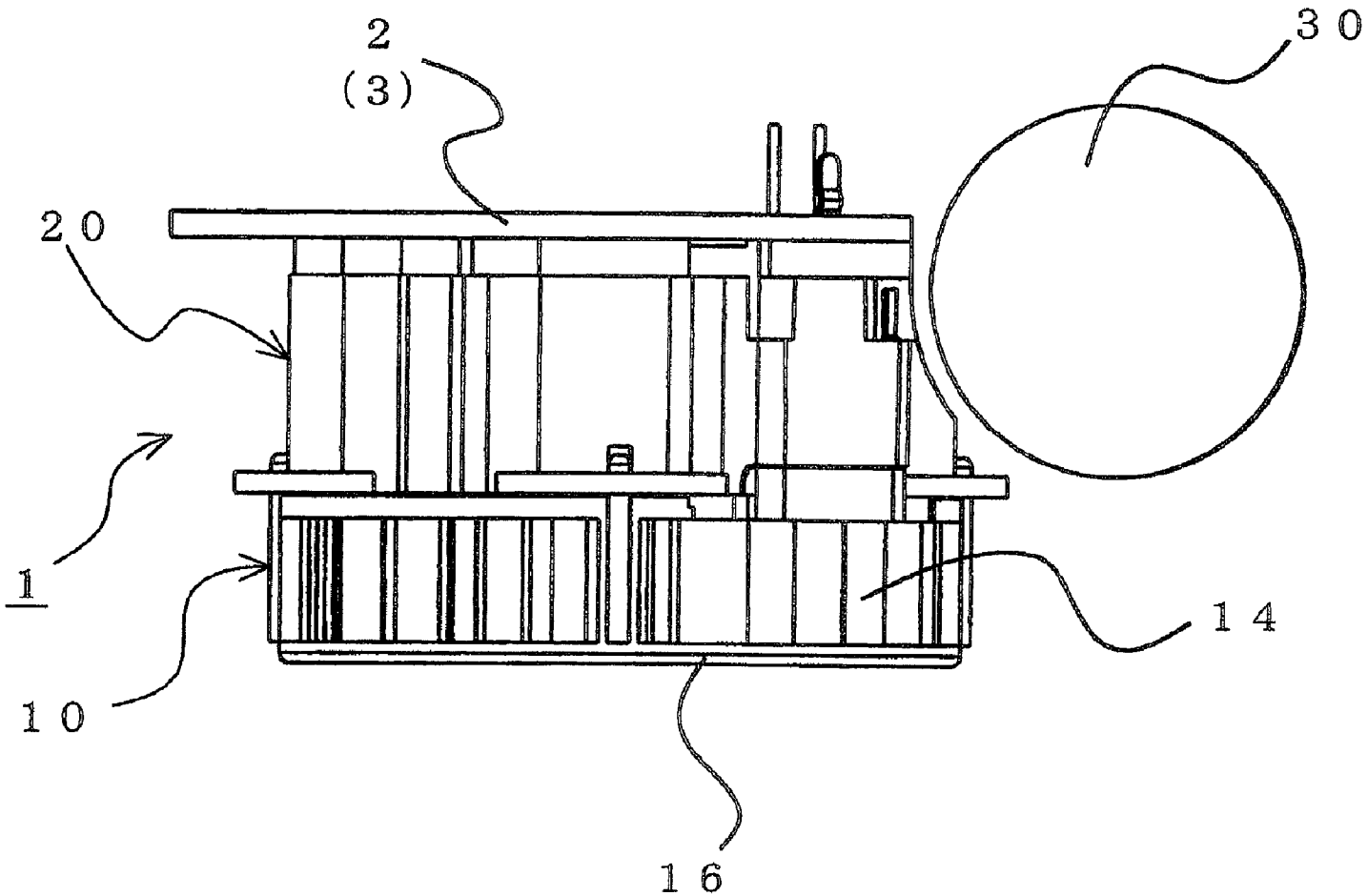
FIG. 3 is a right side view illustrating the smoke detecting unit of the smoke alarm device according to the embodiment of the present invention.
Figure 4:
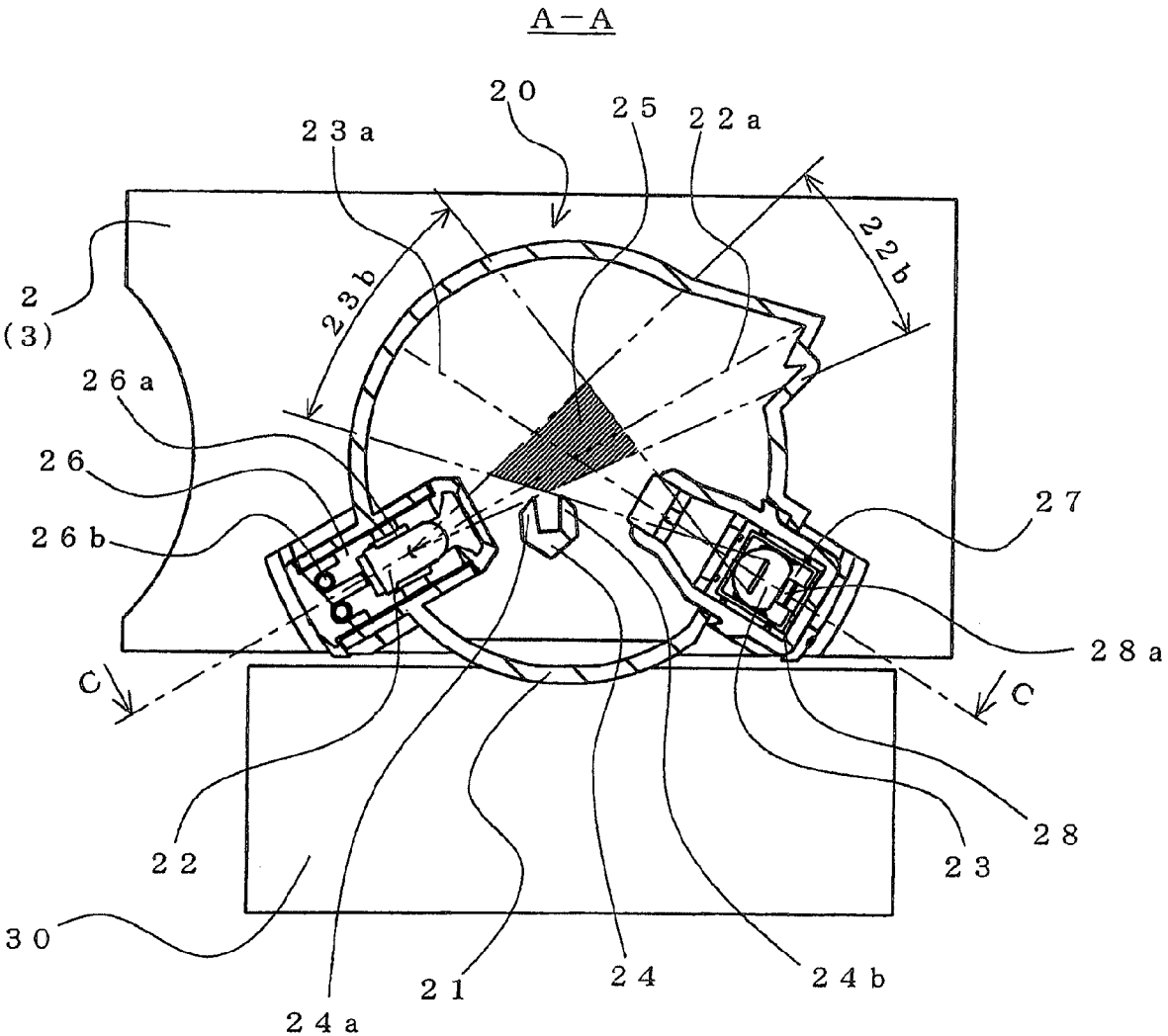
FIG. 4 is a cross sectional view taken along the line A-A of FIG. 1.
Figure 5:
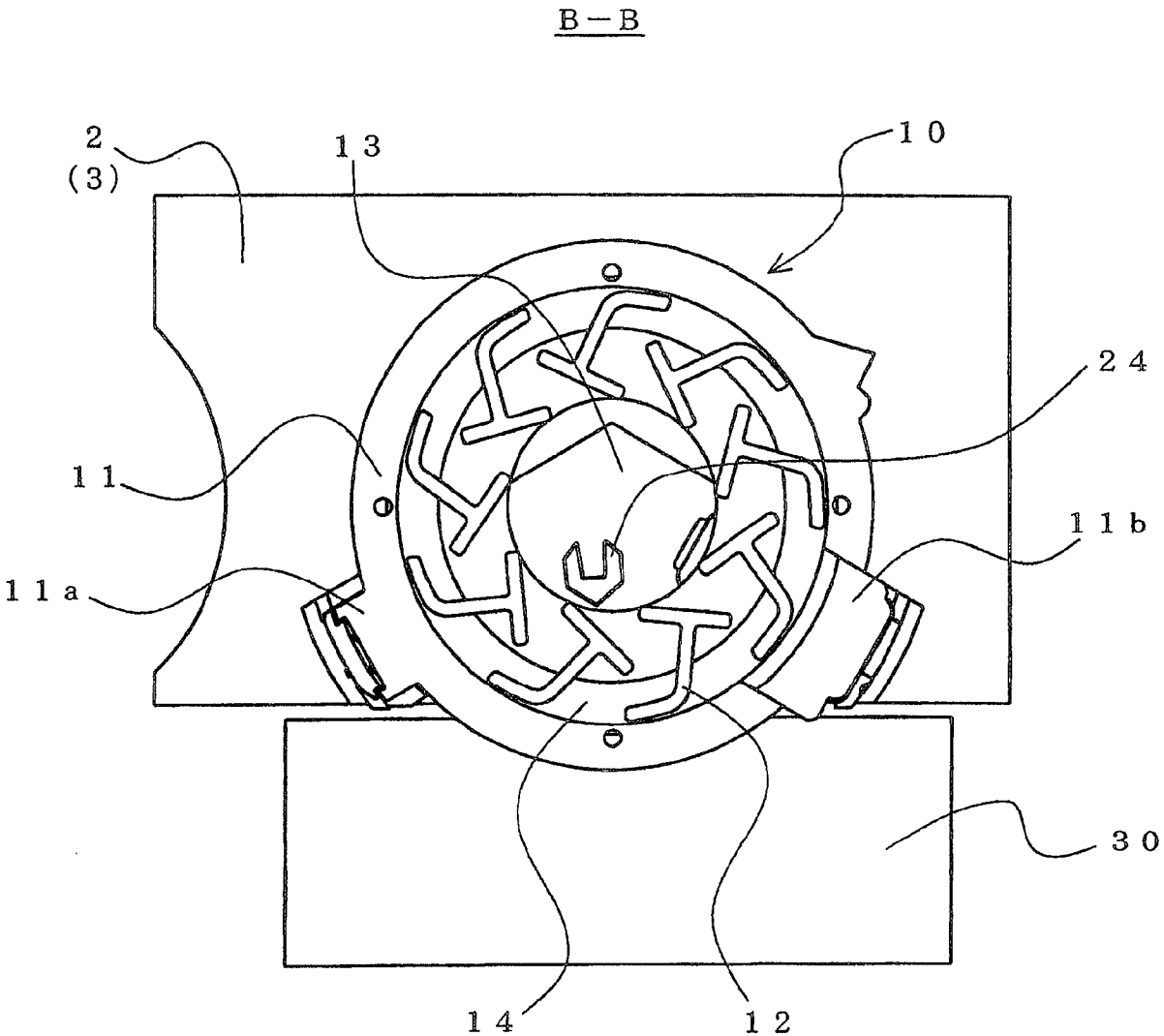
FIG. 5 is a cross sectional view taken along the line B-B of FIG. 1.

FIG. 1 is a vertical cross sectional view illustrating a smoke detecting unit of the smoke alarm device according to the embodiment of the present invention, FIG. 2 is a bottom view of the smoke detecting unit, FIG. 3 is a right side view of the smoke detecting unit, FIG. 4 is a cross sectional view taken along the line A-A of FIG. 1, and FIG. 5 is a cross sectional view taken along the line B-B of FIG. 1. FIGS. 1 to 5 are not drawn to the same scale. With reference to FIGS. 1 to 5, description is made below of the smoke alarm device according to this embodiment. It should be noted that the description is given below based on the vertical and horizontal directions of FIG. 1.

A smoke detecting unit 1 of a smoke alarm device 100 includes a smoke inlet section 10 and an installation section 20. The smoke inlet section 10 is formed in a substantially cylindrical shape, and includes a plate member 11 and wall members 12. The plate member 11 is formed in a substantially disk shape, and has an opening 13 substantially in a center portion thereof. In the outer peripheral portion of the plate member 11, convex portions 11*a* and 11*b* are formed at positions corresponding to a light emitting element holder 26 and a light receiving element holder 27, respectively, which are described later. On the peripheral edge portion of the plate member 11 on a lower surface side thereof, a plurality of the wall members 12, which are formed in a substantially J-shape, for example, are arranged upright at predetermined intervals in a substantially annular pattern. With this structure, the smoke inlet section 10 is formed in a substantially cylindrical shape so that the upper surface portion thereof is covered with the plate member 11. The wall members 12 prevent external light from entering the smoke inlet section 10. Further, each of the gaps (predetermined intervals) formed between the wall members 12 serves as a smoke inlet 14 for allowing smoke to flow into the smoke inlet section 10. The opening of the smoke inlet section 10 on the lower surface side thereof is closed by a lid member 16, and hence the smoke inlet section 10 is kept dark inside. In addition, an insect screen (not shown) is provided on the side surface portion of the smoke inlet section 10 in order to prevent insects from invading the smoke inlet section 10 through the smoke inlet 14.

The installation section 20 is provided above the smoke inlet section 10. The installation section 20 includes an optical bench 21, a light emitting element 22, a light receiving element 23, and a light shielding member 24. The optical bench 21 is formed in a substantially cylindrical shape with its lower portion open. The optical bench 21 includes the light emitting element holder 26 for accommodating the light emitting element 22, and the light receiving element holder 27 for accommodating the light receiving element 23. The outer end portions of the light emitting element holder 26 and the light receiving element holder 27 are formed so as to project out from the outer peripheral portion of the optical bench 21. In a state in which the smoke inlet section 10 is provided below the installation section 20, the smoke inlet section 10, which is kept dark inside, closes the opening of the optical bench 21. Accordingly, the optical bench 21 is also kept dark inside. Further, in a state in which the smoke inlet section 10 is provided below the installation section 20, the smoke inlet section 10 is communicated with the installation section 20 through the opening 13. It should be noted that in this embodiment, the height dimension of the installation section 20 is larger than the height dimension of the smoke inlet section 10.

The light emitting element holder 26 includes a pair of holding members 26*a* formed of, for example, hooks. The light emitting element 22 is sandwiched between the holding members 26*a* and is accommodated in the light emitting element holder 26. The leading portions of the light emitting element 22 are each bent substantially at a right angle. The bent leading portions are inserted into through-holes 26*b* formed in the light emitting element holder 26, and project out from the upper surface portion of the optical bench 21.

The light receiving element 23 is provided in a shield case 28, and is accommodated in the light receiving element holder 27 together with the shield case 28. The shield case 28 is formed in a substantially rectangular-cylindrical shape in which the upper portion of the shield case 28 and a portion thereof open, the portion falling within a range in which the shield case 28 is opposed to the light receiving portion of the light receiving element 23. The shield case 28 includes a holding member 28*a* formed of, for example, a presser plate. The light receiving element 23 is provided in the shield case 28 while being sandwiched between the side surface portion of the shield case 28 and the holding member 28*a*. A convex portion 28*b* is formed in the upper portion of the shield case 28. The shield case 28 and the light receiving element 23 are fixed by inserting the convex portion 28*b* into an opening formed in a circuit board 2 and by soldering the convex portion 28*b*.

In a state in which the light emitting element 22 and the light receiving element 23 are accommodated in the optical bench 21, the light emitting element 22 is arranged so that an irradiation range 22*b* thereof is oriented substantially toward the center portion of the optical bench 21, and the light receiving element 23 is arranged so that a light receiving range 23*b* thereof is oriented substantially toward the center portion of the optical bench 21. Further, an optical axis 22*a* of the light emitting element 22 and an optical axis 23*a* of the light receiving element 23 are substantially parallel to each other in side view, and form a predetermined angle in plan view. Specifically, smoke is detected in an overlapping region of the irradiation range 22*b* of the light emitting element 22 and the light receiving range 23*b* of the light receiving element 23, the overlapping region corresponding to a smoke detecting region 25. More specifically, the light receiving element 23 receives light, which is emitted from the light emitting element 22 and then is scattered by smoke flowing into the smoke detecting region 25.

Further, the light shielding member 24 is provided upright on the optical bench 21 on a side on which the angle formed between the optical axis 22*a* of the light emitting element 22 and the optical axis 23*a* of the light receiving element 23 is acute. The cross section of the light shielding member 24 in plan view is in, for example, a substantially hexagonal shape, and the corner of the light shielding member 24 on a side facing the center portion of the optical bench 21 is notched to exhibit a substantially U-shape. Accordingly, the light shielding member 24 has an edge portion 24*a* and an edge portion 24*b* formed therein. The edge portion 24*a* prevents the light receiving element 23 from directly receiving light emitted from the light emitting element 22. The edge portion 24*b* prevents the light receiving element 23 from receiving light irregularly reflected by the edge portion 24*a*.

The installation section 20 is installed on a lower surface portion of the circuit board 2. The circuit board 2 has a plurality of electrical components (not shown) mounted thereon, and those electrical components constitute a fire determining unit 3. In a state in which the installation section 20 is installed on the circuit board 2, each of the light emitting element 22 and the light receiving element 23, and the fire determining unit 3 are electrically connected to each other. The fire determining unit 3 determines, based on an amount of received light detected by the light receiving element 23, whether or not a fire has occurred. The amount of received light detected by the light receiving element 23 is output to the fire determining unit 3 in a form of, for example, voltage.

The smoke detecting unit 1 and the circuit board 2 are provided in a casing (not shown) in which an air permeability to the smoke inlet section 10 is ensured, and constitute the smoke alarm device 100. The smoke alarm device 100 is installed in a monitor space such as a house, a building, or a room of a hotel. In a state in which the smoke alarm device 100 is installed to the ceiling of the monitor space, the smoke alarm device 100 is installed, with the smoke inlet section 10 being positioned on the lower side of the smoke alarm device 100 as illustrated in FIG. 1.

The smoke alarm device 100 has a battery 30, such as a lithium battery, as its driving source. Specifically, the battery 30 supplies power to the light emitting element 22 of the smoke detecting unit 1 and the fire determining unit 3 of the circuit board 2. The battery 30 is provided near a side portion of the circuit board 2 on a side on which the angle formed between the optical axis 22*a* of the light emitting element 22 and the optical axis 23*a* of the light receiving element 23 is acute. Further, the battery 30 is arranged so that parts of the upper surface portion and the side surface portion of the installation section 20 are cut out. Specifically, a battery accommodating portion for accommodating the battery 30 therein is arranged so that the parts of the upper surface portion and the side surface portion of the installation section 20 are cut out. With the provision of the battery 30 (battery accommodating portion) so that the parts of the upper surface portion and the side surface portion of the installation section 20 are cut out, it becomes possible to realize the smaller and thinner smoke alarm device 100. It should be noted that the cut-out portion of the installation section 20 is closed so as to prevent external light from entering the installation section 20.

It should be noted that the battery 30 (battery accommodating portion) is not necessarily provided at a position described in this embodiment as long as the part of the installation section 20 is cut out so as not to hinder the smoke detecting function thereof. In other words, the battery 30 (battery accommodating portion) only needs to be formed so that the part of the installation section 20 is cut out, except for the portion including the irradiation range 22*b* extending from the light emitting element 22 to the smoke detecting region 25, and the light receiving range 23*b* extending from the light receiving element 23 to the smoke detecting region 25. On the side on which the angle formed between the optical axis 22*a* of the light emitting element 22 and the optical axis 23*a* of the light receiving element 23 is acute, the smoke detecting region 25 is defined with the intervention of the light shielding member 24, and hence the region is minimum in influence on the smoke detecting function of the installation section 20, which may be caused by the provision of the battery 30 (battery accommodating portion). Thus, in this embodiment, the battery 30 (battery accommodating portion) is arranged so that the parts of the upper surface portion and the side surface portion of the installation section 20 on the side are cut out on which the angle formed between the optical axis 22*a* of the light emitting element 22 and the optical axis 23*a* of the light receiving element 23 is acute.

(Description of Operation)

Next, description is made of operation of the smoke alarm device 100 according to this embodiment.

Figure 6:
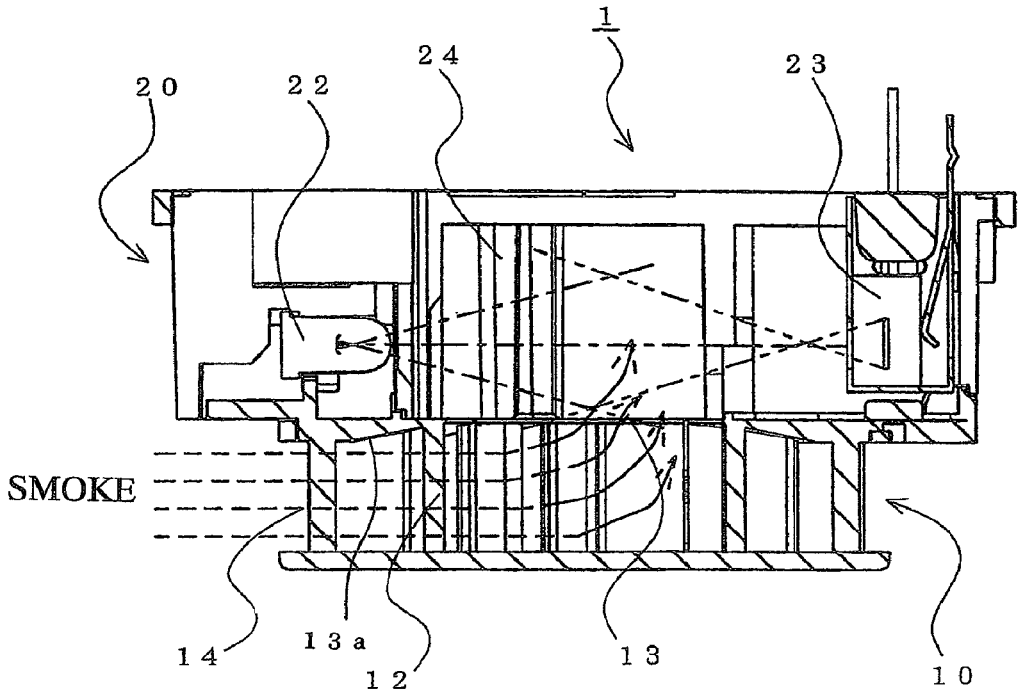
FIGS. 6A and 6B are vertical cross sectional views each illustrating the smoke detecting unit of the smoke alarm device according to the embodiment of the present invention.
Figure 6:
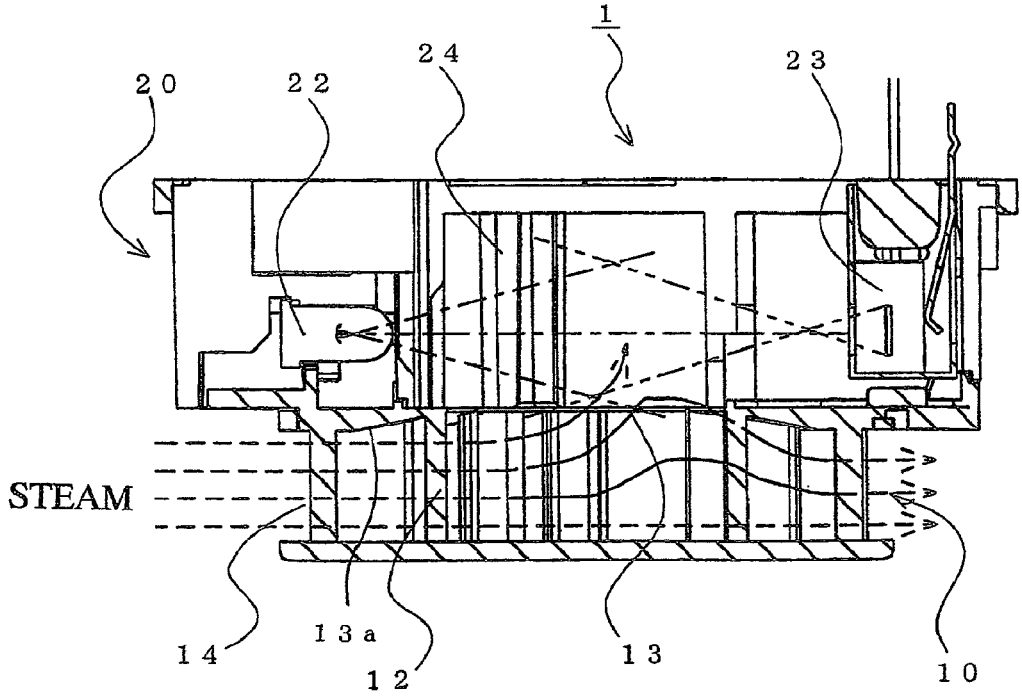

FIGS. 6A and 6B are vertical cross sectional views each illustrating the smoke detecting unit of the smoke alarm device according to the embodiment of the present invention. It should be noted that FIGS. 6A and 6B are cross sectional views taken along the line C-C of FIG. 4. FIG. 6A is a vertical cross sectional view illustrating a state in which smoke flows into the smoke detecting unit 1, and indicates flows of smoke within the smoke detecting unit 1 by the broken-line arrows. FIG. 6B is a vertical cross sectional view illustrating a state in which steam flows into the smoke detecting unit 1, and indicates flows of steam within the smoke detecting unit 1 by the broken-line arrows.

As illustrated in FIG. 6A, smoke generated by a fire flows along the ceiling and the like of the monitor space into the smoke inlet section 10 of the smoke detecting unit 1. On this occasion, the light shielding member 24 is provided only to the installation section 20. In other words, the light shielding member 24 is not disposed to the smoke inlet section 10. Further, the light emitting element 22 and the light receiving element 23 are not disposed to the smoke inlet section 10. Thus, the light shielding member 24 and other components do not interrupt the flows of smoke flowing into the smoke inlet section 10, thereby improving smoke inlet characteristics of the smoke inlet section 10. It should be noted that the light shielding member 24 is not necessarily provided only to the installation section 20, and the tip end portion of the light shielding member 24 may be inserted into the smoke inlet section 10 as long as the smoke inlet characteristics of the smoke inlet section 10 do not decline. With the light shielding member 24 provided to have a length with which the tip end portion of the light shielding member 24 is inserted into the smoke inlet section 10, it becomes possible to prevent more reliably the light receiving element 23 from directly receiving light emitted from the light emitting element 22.

Further, the lower surface of the plate member 11 serving as a partition wall between the installation section 20 and the smoke inlet section 10 constitutes an inclined surface 13*a*, which inclines upward as approaching the opening 13 from the outer periphery side of the plate member 11. Therefore, the smoke flowing into the smoke inlet section 10 is guided along the inclined surface 13*a* into the installation section 20. Accordingly, even the smoke flowing at low speed can be guided to flow into the installation section 20 rapidly.

The mass of the particles in smoke is low, and thus the inertia is also low. Therefore, the fluid state of smoke may be changed easily, and thus the smoke flowing into the smoke inlet section 10 flows into the installation section 20 through the opening 13. When the smoke flows into the installation section 20, the smoke scatters light emitted from the light emitting element 22. The scattered light is received by the light receiving element 23. In other words, the amount of received light detected by the light receiving element 23 changes. Then, the light receiving element 23 outputs the detection value (voltage or the like) according to the amount of received light to the fire determining unit 3. Based on the detection value, the fire determining unit 3 determines whether or not a fire has occurred. When it is determined that a fire has occurred, the fire determining unit 3 issues, to the surroundings, an alarm for the occurrence of the fire by means of an alarm device (not shown) including a light emitting element such as an LED and a buzzer. It should be noted that in this embodiment, the height dimension of the installation section 20 is larger than the height dimension of the smoke inlet section 10, and hence the smoke flowing into the smoke inlet section 10 flows into the installation section 20 easily. Accordingly, the fire determining unit 3 (smoke alarm device 100) can determine whether or not a fire has occurred with high accuracy.

On the other hand, the mass of the particles in steam is high, and thus the inertia is also high. Therefore, as illustrated in FIG. 6B, the fluid state of steam may hardly be changed, and thus the majority of steam flowing into the smoke inlet section 10 does not flow into the installation section 20 and passes through the smoke inlet section 10 to exit. Thus, in the installation section 20, light emitted from the light emitting element 22 is not scattered by steam (or only a little is scattered). Accordingly, even when steam flows into the smoke inlet section 10 (smoke detecting unit 1), the fire determining unit 3 (smoke alarm device 100) does not erroneously determine that a fire has occurred.

In the smoke alarm device 100 thus structured, the smoke detecting unit 1 has the installation section 20 including the light emitting element 22 and the light receiving element 23, and the smoke inlet section 10 in a separate manner. Further, the installation section 20 and the smoke inlet section 10 are arranged so as to overlap each other, with the smoke inlet section 10 being positioned on the lower side of the installation section 20, and are communicated with each other through the opening 13. Accordingly, the smoke alarm device 100 capable of determining whether or not a fire has occurred without issuing an erroneous alarm even when steam flows into the smoke inlet section 10 can be obtained.

Further, the light shielding member 24 is provided only to the installation section 20. In other words, the light shielding member 24 is not provided to the smoke inlet section 10. Further, the light emitting element 22 and the light receiving element 23 are not provided to the smoke inlet section 10. Thus, the light shielding member 24 and other components do not interrupt the flows of smoke flowing into the smoke inlet section 10, thereby improving the smoke inlet characteristics of the smoke inlet section 10.

Further, the height dimension of the installation section 20 is larger than the height dimension of the smoke inlet section 10, and hence smoke flowing into the smoke inlet section 10 flows into the installation section 20 easily. Accordingly, the fire determining unit 3 (smoke alarm device 100) can determine whether or not a fire has occurred with high accuracy.

Further, the lower surface of the plate member 11 is provided with the inclined surface 13*a*, along which smoke flowing into the smoke inlet section 10 is guided into the installation section 20. Hence, smoke can be guided along the inclined surface 13*a* into the installation section 20, and thus even smoke flowing at low speed can be guided to flow into the installation section 20 rapidly. Accordingly, the fire detecting performance can be enhanced.

Further, the angle of the inclined surface 13*a* and the inner diameter of the opening 13 are set so that the smoke flowing along the inclined surface 13*a* to the opening 13 is guided to the smoke detecting region 25 (see FIG. 4) of the installation section 20. Thus, it becomes possible to realize the guiding of smoke into the smoke detecting region 25, and accordingly further enhance the fire detecting performance.

In the smoke detecting unit 1 according to this embodiment, the installation section 20 and the smoke inlet section 10 are arranged so as to overlap each other, with the installation section 20 being positioned on the upper side of the smoke detecting unit 1. However, the present invention is not limited thereto, and the smoke detecting unit 1 may be structured so that the installation section 20 and the smoke inlet section 10 are arranged so as to overlap each other, with the smoke inlet section 10 being positioned on the upper side of the smoke detecting unit 1. By positioning the installation section 20 on the upper side of the smoke detecting unit 1, the smoke detecting unit 1 can be installed on the circuit board 2, with the installation section 20 being positioned on the circuit board 2 side. Accordingly, the light receiving element 23 of the installation section 20 can be easily connected to the fire determining unit 3 of the circuit board 2. For this reason, in the smoke detecting unit 1 according to this embodiment, the installation section 20 and the smoke inlet section 10 are arranged so as to overlap each other, with the installation section 20 being positioned on the upper side of the smoke detecting unit 1.

Moreover, even when the smoke alarm device 100 is installed on a side wall surface substantially orthogonal to the ceiling, with the orientation of the smoke alarm device 100 changed, smoke and steam flow as illustrated in FIGS. 6A and 6B, respectively. Accordingly, there can be obtained an effect similar to that in the case of installation of the smoke alarm device 100 on the ceiling.

While the present invention has been applied to the smoke alarm device 100 in this embodiment, the present invention may obviously be also applied to a fire detector.

What is claimed is:

1. A photoelectric smoke detector comprising:

a smoke detecting unit; and a fire determining unit for determining, based on a signal output from the smoke detecting unit, whether or not a fire has occurred, the photoelectric smoke detector outputting a fire signal when the fire determining unit determines that the fire has occurred, wherein the smoke detecting unit comprises:

an installation section; and a smoke inlet section, wherein the installation section comprises:

a light emitting element for emitting light to an inside of the installation section; and a light receiving element for receiving the light which is emitted from the light emitting element and scattered by smoke particles within the smoke detecting unit, wherein the smoke inlet section comprises:

a plurality of wall members for preventing external light from entering the smoke inlet section; and a smoke inlet formed between the plurality of wall members, and wherein a smoke detecting region is defined in the installation section, wherein the installation section and the smoke inlet section are arranged so as to overlap each other, with the smoke inlet section being positioned on a lower side of the installation section when the photoelectric smoke detector is installed on a ceiling of a monitor space, wherein the smoke inlet section further comprises a partition wall having an opening through which the smoke inlet section is communicated with the installation section, wherein the partition wall has a lower surface that has the plurality of wall members formed thereon, and that has an inclined surface which inclines upwardly in a direction toward the opening so as to guide smoke flowing into the smoke inlet section through the opening into the installation section, and wherein an angle of the inclined surface and an inner diameter of the opening are set so that the smoke flowing along the inclined surface of the partition wall is guided to the smoke detecting region defined in the installation section.

2. The photoelectric smoke detector of claim 1, further comprising a light shielding member for preventing the light receiving element from directly receiving the light emitted from the light emitting element, wherein the light emitting element and the light receiving element are arranged such that an optical axis of the light emitting element and an optical axis of the light receiving element form an angle in a radial direction of the photoelectric smoke detector, and wherein the light shielding member is not in contact with a surface of the smoke inlet section opposite to the installation section.

3. The photoelectric smoke detector of claim 2, wherein a height dimension of the installation section is larger than a height dimension of the smoke inlet section.

4. The photoelectric smoke detector of claim 2, wherein the light emitting element and the light receiving element are arranged such that an optical axis of the light emitting element and an optical axis of the light receiving element are parallel to each other in an axial direction of the photoelectric smoke detector, the axial direction of the photoelectric smoke detector being perpendicular to the radial direction of the photoelectric smoke detector.

5. The photoelectric smoke detector of claim 1, wherein a height dimension of the installation section is larger than a height dimension of the smoke inlet section.

6. The photoelectric smoke detector of claim 1, wherein the partition wall is disposed between the plurality of wall members and the installation section in an axial direction of the photoelectric smoke detector.

7. The photoelectric smoke detector of claim 1, wherein the light emitting element is disposed on an opposite side of the partition wall from the plurality of wall members.

8. The photoelectric smoke detector of claim 1, wherein the installation section and the smoke inlet section are configured such that smoke which enters the smoke inlet section passes into the installation section and scatters light emitted by the light emitting element to cause the fire determining unit to determine that a fire has occurred, and wherein the installation section and the smoke inlet section are configured such that steam which enters the smoke inlet section does not pass into the installation section in sufficient quantity to scatter light emitted by the light emitting element and cause the fire determining unit to determine that a fire has occurred.

* * * * *